US011566309B2

(12) United States Patent
Oliver et al.

(10) Patent No.: US 11,566,309 B2
(45) **Date of Patent: *Jan. 31, 2023**

(54) DUPLEX FERRITIC AUSTENITIC STAINLESS STEEL

(71) Applicant: OUTOKUMPU OYJ, Espoo (FI)

(72) Inventors: James Oliver, Fjärdhundra (SE); Erik Schedin, Uppsala (SE); Rachel Pettersson, Norrtälje (SE)

(73) Assignee: Outokumpu Oyj, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/897,560

(22) PCT Filed: Jun. 12, 2014

(86) PCT No.: PCT/FI2014/050476

§ 371 (c)(1),
(2) Date: Dec. 10, 2015

(87) PCT Pub. No.: WO2014/199019

PCT Pub. Date: Dec. 18, 2014

(65) Prior Publication Data

US 2016/0115574 A1 Apr. 28, 2016

(30) Foreign Application Priority Data

Jun. 13, 2013 (FI) ..... 20135649

(51) Int. Cl.

| | |
|---|---|
| ***C22C 38/58*** | (2006.01) |
| ***C22C 38/42*** | (2006.01) |
| ***C22C 38/00*** | (2006.01) |
| ***C22C 38/02*** | (2006.01) |
| ***C22C 38/54*** | (2006.01) |
| ***C21D 6/00*** | (2006.01) |
| ***C22C 38/40*** | (2006.01) |
| ***C22C 38/44*** | (2006.01) |
| *C21D 9/00* | (2006.01) |

(52) U.S. Cl.

CPC ..... *C22C 38/58* (2013.01); *C21D 6/002* (2013.01); *C22C 38/001* (2013.01); *C22C 38/005* (2013.01); *C22C 38/02* (2013.01); *C22C 38/40* (2013.01); *C22C 38/42* (2013.01); *C22C 38/44* (2013.01); *C22C 38/54* (2013.01); *C21D 9/0081* (2013.01); *C21D 2211/001* (2013.01); *C21D 2211/005* (2013.01)

(58) Field of Classification Search

CPC ..... C22C 38/02

See application file for complete search history.

(56) References Cited

U.S. PATENT DOCUMENTS

| | | | | |
|---|---|---|---|---|
| 4,591,644 | A | 5/1986 | Leerschool et al. | |
| 4,828,630 | A | 5/1989 | Daniels et al. | |
| 2003/0172999 | A1* | 9/2003 | Alfonsson | C22C 38/06 148/325 |
| 2011/0097234 | A1 | 4/2011 | Oikawa et al. | |

FOREIGN PATENT DOCUMENTS

| | | | | |
|---|---|---|---|---|
| CN | 103382540 | A | 11/2013 | |
| EP | 1327008 | B | 2/2006 | |
| EP | 1715073 | A1 | 10/2006 | |
| EP | 1786975 | A1 | 5/2007 | |
| EP | 2172574 | A1 | 4/2010 | |
| EP | 2050832 | B1 | 5/2012 | |
| JP | 2006183129 | A * | 7/2006 | |
| JP | 2010222695 | A | 10/2010 | |
| JP | 2258885 | A1 * | 12/2010 | C22C 38/001 |
| JP | 2012126992 | A | 7/2012 | |
| WO | 2010/070202 | A1 | 6/2010 | |
| WO | 2012/004473 | A1 | 1/2012 | |
| WO | 2013/081422 | A1 | 6/2013 | |

OTHER PUBLICATIONS

McGuire, Michael F . . . (2008). Stainless Steels for Design Engineers. ASM International, pp. 91-107.*

English Machine Translation of JP 2006183129 A published Jul. 13, 2006.*

International Search Report for PCT/FI/2014/050476, issued by the Finnish Patent and Registration Office, dated Oct. 22, 2014, 4 pages.

Examination Report prepared by the Australian Patent Office for AU 2014279972, dated Oct. 13, 2017, 3 pages.

Extended European Search Report prepared by the European Patent Office for EP 3008222, dated Jan. 13, 2017, 13 pages.

Office Action prepared by the Finnish Patent and Registration Office for FI 20135649, dated Mar. 21, 2014, 5 pages.

Office Action prepared by the Eurasian Patent Organization for 201592160/28, dated Aug. 14, 2016, 2 pages.

* cited by examiner

*Primary Examiner* — Jophy S. Koshy
(74) *Attorney, Agent, or Firm* — Quinn IP Law

(57) ABSTRACT

Disclosed is a duplex ferritic austenitic stainless steel of 40-60 volume % ferrite and 40-60 volume % austenite, with improved cold workability and impact toughness. It contains less than 0.07% carbon (C), 0.1-2.0% silicon (Si), 3-5% manganese (Mn), 19-23% chromium (Cr), 1.1-1.9% nickel (Ni), 1.1-3.5% copper (Cu), 0.18-0.30% nitrogen (N), optionally molybdenum (Mo) and/or tungsten (W) according to the formula (Mo+½W)<1.0%. It optionally contains 0.001-0.005% boron (B), up to 0.03% of each of cerium (Ce) and/or calcium (Ca), with the balance being iron (Fe) and impurities where the chromium equivalent ($Cr_{eq}$) and the nickel equivalent ($Ni_{eq}$): $20<Cr_{eq}<24.5$ and $Ni_{eq}>10$, where $Cr_{eq}=Cr+1.5Si+Mo+2Ti+0.5Nb$ $Ni_{eq}=Ni+0.5Mn+30(C+N)+0.5(Cu+Co)$.

15 Claims, 2 Drawing Sheets

DUPLEX FERRITIC AUSTENITIC STAINLESS STEEL

CROSS-REFERENCE TO RELATED APPLICATIONS

This is a national stage application filed under 35 USC 371 based on International Application No. PCT/FI2014/050476 filed Jun. 12, 2014 and claims priority under 35 USC 119 of Finnish Patent Application No. 20135649 filed Jun. 13, 2013.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

This invention relates to a duplex ferritic austenitic stainless steel having a microstructure, which essentially consists of 40-60 volume % ferrite and 40-60 volume % austenite, preferably 45-55 volume % ferrite and 45-55 volume % austenite, and having improved cold workability and impact toughness properties by addition of copper.

BRIEF SUMMARY OF THE INVENTION

Typically the copper content is limited in stainless steels to approximately 3 weight % in order to avoid primarily hot cracking that occurs during welding, casting or hot working at temperatures close to the melting point. However, lower levels (0.5-2.0 weight %) do exist in stainless steel grades and can result in higher machinability and improve the cold working process. Duplex stainless steels generally have good hot cracking resistance.

It is known from the EP patent 1327008 a duplex ferritic austenitic stainless steel which is marketed under the trademark LDX 2101® and contains in weight % 0.02-0.07% carbon (C), 0.1-2.0% silicon (Si), 3-8% manganese (Mn), 19-23% chromium (Cr), 1.1-1.7% nickel (Ni), 0.18-0.30% nitrogen (N), optionally molybdenum (Mo) and/or tungsten (W) in a total amount of maximum 1.0% within the formula (Mo+½W), optionally up to maximum 1.0% copper (Cu), optionally 0.001-0.005% boron (B), optionally up to 0.03% of each of cerium (Ce) and/or calcium (Ca), balance being iron (Fe) and inevitable impurities in such conditions for the ferrite formers and the austenite formers, i.e. for the chromium equivalent ($Cr_{eq}$) and the nickel equivalent ($Ni_{eq}$): $20<Cr_{eq}<24.5$ and $Ni_{eq}>10$, where $$Cr_{eq}=Cr+1.5Si+Mo+2Ti+0.5Nb$$

$$Ni_{eq}=Ni+0.5Mn+30(C+N)+0.5(Cu+Co).$$

In this EP patent 1327008 it is said for copper that copper is a valuable austenite former and can have a favourable influence on the corrosion resistance in some environments. But on the other hand, there is a risk of precipitation of copper in case of too high contents thereof, wherefore the copper content should be maximized to 1.0 weight %, preferably to maximum 0.7 weight %.

As described in the EP patent 1786975, the ferritic austenitic stainless steel of the EP patent 1327008 has good machinability and, therefore, suitable for instance for cutting operations.

The EP patent application 1715073 relates to a low nickel and high nitrogen austenitic-ferritic stainless steel in which steel the percentage of the austenite phase is adjusted in a range of 10-85 vol %. Respectively the ferrite phase is in the range of 15-90 vol %. High formability for this austenitic-ferritic stainless steel has been achieved by adjusting the sum of the carbon and nitrogen contents (C+N) in the austenite phase to a range from 0.16 to 2 weight %. Further, in the document EP 1715073 copper is mentioned as an optional element with the range less than 4 weight %. The document EP 1715073 shows a very big number of chemical compositions for tested stainless steels, but only very few steels contain more than 1 weight % copper. Copper is thus described only as one alternative element for the stainless steel of the EP 1715073 in order to increase corrosion resistance, but the EP 1715073 does not describe any other effects of copper in the properties of the stainless steel within the copper range mentioned.

The WO publication 2010/070202 describes a duplex ferritic austenitic stainless steel containing in weight % 0.005-0.04% carbon (C), 0.2-0.7% silicon (Si), 2.5-5% manganese (Mn), 23-27% chromium (Cr), 2.5-5% nickel (Ni), 0.5-2.5% molybdenum (Mo), 0.2-0.35% nitrogen (N), 0.1-1.0% copper (Cu), optionally less than 1% tungsten (W), less than 0.0030% one or more elements of the group containing boron (B) and calcium (Ca), less than 0.1% cerium (Ce), less than 0.04% aluminium (Al), less than 0.010% sulphur (S) and the rest iron (Fe) and incidental impurities. In this WO publication WO 2010/070202 it is said for copper that copper has been known to suppress formation of intermetallic phase with a content more than 0.1 weight %, and more than 1 weight % copper results in larger amount of intermetallic phase.

The WO publication 2012/004473 relates to an austenitic ferritic stainless steel having improved machinability. The steel contains in weight % 0.01-0.1% carbon (C), 0.2-1.5% silicon (Si), 0.5-2.0 manganese (Mn), 20.0-24.0% chromium (Cr), 1.0-3.0% nickel (Ni), 0.05-1.0% molybdenum (Mo) and 0.15% tungsten (W) so that $0.05<Mo+\frac{1}{2}W<1.0\%$, 1.6-3.0% copper (Cu), 0.12-0.20% nitrogen (N), ≤0.05% aluminium (Al), ≤0.5% vanadium (V), ≤0.5% niobium, ≤0.5% titanium (Ti), ≤0.003% boron (B), ≤0.5% cobalt (Co), 1.0% REM (Rear Earth Metal), ≤0.03% calcium (Ca), ≤0.1% magnesium (Mg), ≤0.005% selenium (Se), the remainder being iron (Fe) and impurities. It is said for copper in this publication, that copper present in a content of between 1.6-3.0% contributes to the achievement of the two-phase austenitic ferritic structure desired, to obtain a better resistance to general corrosion without having to increase the rate of nitrogen in the shade too high. Below 1.6% copper, the rate of nitrogen required for the desired phase structure starts to become too large to avoid the problems of the surface quality of continuously cast blooms, and above 3.0% copper, it begins to risk segregation and/or precipitation of copper can and thus generates resistance to localized corrosion and decreases resilience prolonged use.

The JP publication 2010222695 relates to a ferritic austenitic stainless steel containing in weight % 0.06% or less C, 0.1-1.5% Si, 0.1-6.0% Mn, 0.05% or less P, 0.005% or less S, 0.25-4.0% Ni, 19.0-23.0% Cr, 0.05-1.0% Mo, 3.0% or less Cu, 0.15-0.25% N, 0.003-0.050% Al, 0.06-0.30% V and 0.007% or less 0, while controlling Ni-bal. represented by expression $$\text{Ni-bal.}=(\text{Ni}+0.5\text{Mn}+0.5\text{Cu}+30\text{C}+30\text{N})-1{,}1(\text{Cr}+1.5\text{Si}+\text{Mo}+\text{W})+8.2$$

to be −8 to −4 and includes 40-70% by an area rate of austenite phases.

The US publication 2011097234 describes a lean duplex stainless steel able to suppress the drop in corrosion resistance and toughness of a weld heat affected zone and it is characterized by containing, in weight %, C: 0.06% or less, Si: 0.1 to 1.5%, Mn: 2.0 to 4.0%, P: 0.05% or less, S: 0.005% or less, Cr: 19.0 to 23.0%, Ni: 1.0 to 4.0%, Mo: 1.0% or less, Cu: 0.1 to 3.0%, V: 0.05 to 0.5%, Al: 0.003 to 0.050%, 0: 0.007% or less, N: 0.10 to 0.25%, and Ti: 0.05% or less, having a balance of Fe and unavoidable impurities, having an $M_{d30}$ temperature value expressed by formula $$M_{d30}=551-462(\text{C}+\text{N})-9.2\text{Si}-8.1\text{Mn}-29(\text{Ni}+\text{Cu})-13.7\text{Cr}-18.5\text{Mo}-68\text{Nb}$$

of 80 or less, having an Ni-bal expressed by formula $$\text{Ni-bal}=(\text{Ni}+0.5\text{Mn}+0.5\text{Cu}+30\text{C}+30\text{N})-1.1(\text{Cr}+1.5\text{Si}+\text{Mo}+\text{W})+8.2$$

of −8 to −4, and having a relationship between the Ni-bal and the N content satisfying the formula $$\text{N}(\%)\leq 0.37+0.03(\text{Ni-bal})$$

and further having an austenite phase area percentage of 40 to 70%, and having a 2Ni+Cu of 3.5 or more.

In both publications, the JP publication 2010222695 and the US publication 2011097234, vanadium is an important additive element, because according to those publications vanadium lowers the activity of nitrogen and thus delays the precipitation of nitrides. The precipitation of nitrides is critical, because nitrogen is added to improve the corrosion resistance of a heat affected zone (HAZ) during welding, and with high nitrogen the risk of property degradation by the nitride deposit to the grain boundaries will arise.

The object of the present invention is to eliminate some drawbacks of the prior art and to improve the duplex ferritic austenitic stainless steel according to the EP patent 1327008 in cold workability and in impact toughness with an increase in the copper content. The essential features of the present invention are enlisted in the appended claims.

According to the invention, it was found, that increasing the copper content in the duplex ferritic austenitic stainless steel as described in the EP patent 1327008 and marketed under the trademark LDX 2101®, so that the ferritic austenitic stainless steel contains 1.1-3.5 weight % copper, the cold workability properties were improved. The addition of copper has also effects to machinability. The duplex ferritic austenitic stainless steel according to the invention, having 40-60 volume % ferrite and 40-60 volume % austenite, preferably 45-55 volume % ferrite and 45-55 volume % austenite at the annealed condition, contains in weight % less than 0.07% carbon (C), 0.1-2.0% silicon (Si), 3-5% manganese (Mn), 19-23% chromium (Cr), 1.1-1.9% nickel (Ni), 1.1-3.5% copper (Cu), 0.18-0.30% nitrogen (N), optionally molybdenum (Mo) and/or tungsten (W) in a total amount calculated with the formula (Mo+½W)≤1.0%, optionally 0.001-0.005% boron (B), optionally up to 0.03% of each of cerium (Ce) and/or calcium (Ca), balance being iron (Fe) and inevitable impurities in such conditions for the ferrite formers and the austenite formers, i.e. for the chromium equivalent ($Cr_{eq}$) and the nickel equivalent ($Ni_{eq}$): $20<Cr_{eq}<24.5$ and $Ni_{eq}>10$, where $$Cr_{eq}=\text{Cr}+1.5\text{Si}+\text{Mo}+2\text{Ti}+0.5\text{Nb}$$

$$Ni_{eq}=\text{Ni}+0.5\text{Mn}+30(\text{C}+\text{N})+0.5(\text{Cu}+\text{Co}).$$

The duplex ferritic austenitic stainless steel according to the invention contains preferably 1.1-2.5 weight % copper, more preferably 1.1-1.5 weight % copper. The critical pitting temperature (CPT) of the steel according to the invention is 13-19° C., preferably 13.4-18.9° C., more preferably 14.5-17.7° C.

Effects of different elements in the microstructure are described in the following, the element contents being described in weight %:

Carbon (C) contributes to the strength of the steel and it is also a valuable austenite former It is, however, time consuming to bring the carbon content down to low levels in connection with the decarburisation of the steel, and it is also expensive because it increases the consumption of reduction agents. If the carbon content is high, there is a risk for precipitation of carbides, which can reduce the impact toughness of the steel and the resistance to intercrystalline corrosion. It shall also be considered that carbon has a very small solubility in the ferrite, which means that the carbon content of the steel substantially is collected in the austenitic phase. The carbon content therefore shall be restricted to max 0.07%, preferably to max 0.05%, and suitably to max 0.04%.

Silicon (Si) can be used for deoxidizing purposes at the manufacturing of the steel and exists as a residue from the manufacturing of the steel in an amount of at least 0.1%. Silicon has favourable features in the steel to the effect that it strengthens the high temperature strength of the ferrite, which has a significant importance at the manufacturing. Silicon also is a strong ferrite former and participates as such in the stabilisation of the duplex structure and should from these reasons exist in an amount of at least 0.2%, preferably in an amount of at least 0.35%. Silicon, also have some unfavourable features because it pronouncedly reduces the solubility for nitrogen, which shall exist in high amounts, and if the content of silicon is high also the risk of precipitation of undesired intermetallic phases is increased. The silicon content therefore is limited to max 2.0%, preferably to max 1.5%, and suitably to max 1.0%. An optimal silicon content is 0.35-0.80%.

Manganese (Mn) is an important austenite former and increases the solubility for nitrogen in the steel and shall therefore exist in an amount of at least 3%, preferably at least 3.8%. Manganese, on the other hand, reduces the corrosion resistance of the steel. Moreover it is difficult to decarburise stainless steel melts having high contents of manganese, which means that manganese need to be added after finished decarburisation in the form of comparatively pure and consequently expensive manganese. The steel therefore should not contain more than 5% manganese. An optimal content is 3.8-4.5% manganese.

Chromium (Cr) is the most important element for the achievement of a desired corrosion resistance of the steel.

Chromium also is the most important ferrite former of the steel and gives in combination with other ferrite formers and with a balanced content of the austenite formers of the steel a desired duplex character of the steel. If the chromium content is low, there is a risk that the steel will contain martensite and if the chromium content is high, there is a risk of impaired stability against precipitation of intermetallic phases and so called 475-embrittlement, and an unbalanced phase composition of the steel. From these reasons the chromium content shall be at least 19%, preferably at least 20%, and suitably at least 20.5%, and max 23%, suitably max 22.5%. A suitable chromium content is 21.0-22.0%, nominally 21.2-21.8%.

Nickel (Ni) is a strong austenite former and has a favourable effect on the ductility of the steel and shall therefore exist in an amount of least 1.1%. However, the raw material price of nickel often is high and fluctuates, wherefore nickel, according to an aspect of the invention, is substituted by other alloy elements as far as is possible. Nor is more than 1.9% nickel necessary for the stabilisation of the desired duplex structure of the steel in combination with other alloy elements. An optimal nickel content therefore is 1.35-1.90% Ni.

Molybdenum (Mo) is an element which can be omitted according to a wide aspect of the composition of the steel, i. e. molybdenum is an optional element in the steel of the invention. Molybdenum, however, together with nitrogen has a favourable synergy effect on the corrosion resistance. In view of the high nitrogen content of the steel, the steel therefore should contain at least 0.1% molybdenum, preferably at least 0.15%.

Molybdenum, however, is a strong ferrite former, and it can stabilize sigma-phase in the microstructure of the steel, and it also has a tendency to segregate. Further, molybdenum is an expensive alloy element. From these reasons the molybdenum content is limited to max 1.0%, preferably to max 0.8%, suitably to max 0.65%. An optimal molybdenum content is 0.15-0.54%. Molybdenum can partly be replaced by the double amount of tungsten (W), which has properties similar to those of molybdenum. The total amount of molybdenum and tungsten is calculated in accordance with the formula $(Mo+\frac{1}{2}W)\leq 1.0\%$. In a preferred composition of the steel, however, the steel does not contain more than max 0.5% tungsten.

Copper (Cu) is a valuable austenite former and can have a favourable influence on the corrosion resistance in some environments, especially in some acid media. Copper also improves cold working and impact toughness of the stainless steel according to the invention. Therefore, copper shall exist in an amount of at least 1.1%. The steel of the invention contains preferably 1.1-3.5% copper, more preferably 1.0-2.5% copper, and most preferably 1.1-1.5% copper.

Nitrogen (N) has a fundamental importance because it is the dominating austenite former of the steel. Nitrogen also contributes to the strength and corrosion resistance of the steel and shall therefore exist in a minimum amount of 0.15%, preferably at least 0.18%. The solubility of nitrogen in the steel, however, is limited. In case of a too high nitrogen content there is a risk of formation of flaws when the steel solidifies, and a risk of formation of pores in connection with welding of the steel. The steel therefore should not contain more than 0.30% nitrogen, preferably max 0.26% nitrogen. An optimal content is 0.20-0.24%.

Boron (B) can optionally exist in the steel as a micro alloying addition up to max 0.005% (50 ppm) in order to improve the hot ductility of the steel. If boron exists as an intentionally added element, it should exist in an amount of at least 0.001% in order to provide the desired effect with reference to improved hot ductility of the steel.

In a similar way, cerium and/or calcium optionally may exist in the steel in amounts of max 0.03% of each of said elements in order to improve the hot ductility of the steel.

Besides the above mentioned elements, the steel does not essentially contain any further intentionally added elements, but only impurities and iron. Phosphorus is, as in most steels, a non-desired impurity and should preferably not exist in an amount higher than max 0.035%. Sulphur also should be kept at as low as is possible from an economically manufacturing point of view, preferably in an amount of max 0.10%, suitably lower, e. g. max 0.002% in order not to impair the hot ductility of the steel and hence its rollability, which can be a general problem in connection with the duplex steels.

BRIEF DESCRIPTION OF THE SEVERAL VIEWS OF THE DRAWINGS

The test results of the ferritic austenitic stainless steels of the invention are illustrated in more details in the following drawings, where.

DETAILED DESCRIPTION OF THE INVENTION

Figure 1:
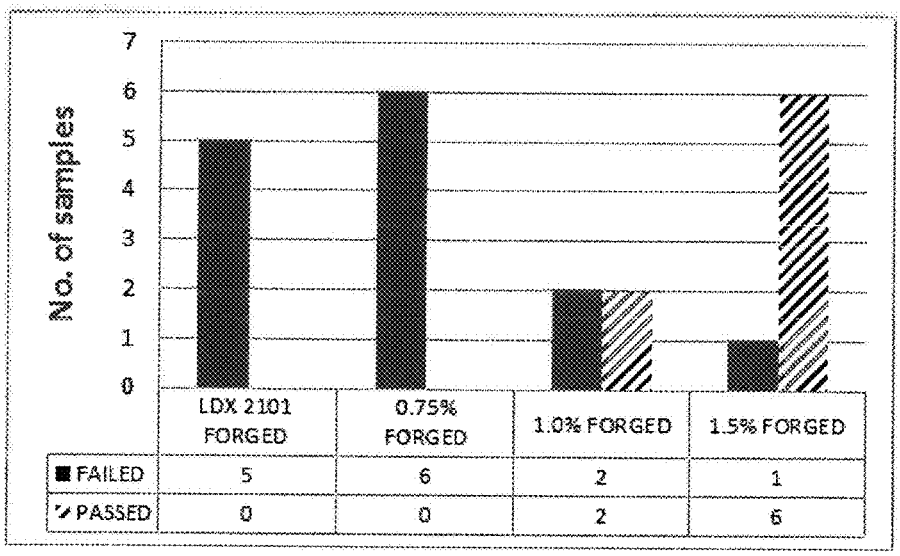
FIG. 1 shows the mechanic test results for steels in a as-forged condition.

The effect of copper to the cold workability properties was tested using for each alloy the 30 kg melts received from a vacuum furnace. Before mechanical testing, the alloys were forged to a final thickness of 50 mm. For all melts the duplex ferritic austenitic stainless steel marketed under the trademark LDX 2101® was used as the base material with varying additions of copper. The chemical compositions of the alloys to be tested are described in the table 1, which also contains the chemical composition for the respective melt of the steel marketed under the trademark LDX 2101®:

TABLE 1

| Alloy | C | Si | Mn | Cr | Ni | Cu | N | Fe + impurities |
|---|---|---|---|---|---|---|---|---|
| LDX 2101 ® | 0.021 | 0.76 | 4.83 | 21.34 | 1.58 | 0.40 | 0.240 | Balance |
| 0.75% Cu | 0.014 | 0.59 | 4.09 | 21.56 | 1.62 | 0.74 | 0.186 | Balance |
| 0.85% Cu* | 0.028 | 0.83 | 3.81 | 21.08 | 1.50 | 0.86 | 0.25 | Balance |
| 1.0% Cu | 0.015 | 0.60 | 4.14 | 21.22 | 1.93 | 1.01 | 0.200 | Balance |
| 1.1% Cu* | 0.013 | 0.88 | 4.42 | 21.18 | 1.36 | 1.12 | 0.22 | Balance |
| 1.5% Cu | 0.015 | 0.55 | 4.15 | 21.33 | 1.6 | 1.50 | 0.188 | Balance |
| 2.5% Cu* | 0.028 | 0.79 | 4.04 | 21.17 | 1.36 | 2.55 | 0.19 | Balance |
| 3.5% Cu* | 0.012 | 0.80 | 3.82 | 20.87 | 1.38 | 3.57 | 0.21 | Balance |

Chemical compositions; *200 g small scale melt

The microstructure investigations were performed primarily to check the ferrite content. This is, because copper is an austenite stabiliser and it was expected that the austenite content was increased with the additions of copper. When maintaining the ferrite content at least 45 volume %, the manganese content, as an austenite stabilizer, was reduced to approximately at the range of 3-5%. It was also considered necessary for the copper to be fully dissolved within the ferrite phase since copper particles or copper rich phases can be detrimental to the pitting corrosion resistance.

The microstructures of the samples were revealed by etching in Behara II solution after annealing at the temperature of 1050 and/or 1150° C. The annealing was done by solution annealing. The microstructure of the 0.85% Cu alloy is essentially the same as the reference alloy. At the copper levels of 1.1% Cu and higher the ferrite phase content becomes successively low. The secondary austenite phase forms readily with the additions of 2.5% Cu and copper particles are present in the ferrite phase when annealed at the temperature of 1050° C., but can be dissolved when annealed at the temperature of 1150° C. as the ferrite content increases. The alloy with 3.5% Cu has copper particles in the ferrite phase even when annealed in the temperature of 1150° C.

The ferrite contents for the annealed samples at the annealing temperatures (T) 1050° C. and 1150° C. were measured using image analysis, and the results are presented in the table 2:

TABLE 2

Ferrite contents

| Alloy | As-forged (%) | T 1050° C. (%) | T 1150° C. (%) |
|---|---|---|---|
| LDX 2101 ® | 62.5 | 54.1 | |
| 0.75% Cu | 66.2 | 60.2 | |
| 0.85% Cu | | 53.1 | |
| 1.0% Cu | 61.5 | 55.4 | |
| 1.1% Cu | | 44.2 | 50.0 |
| 1.5% Cu | 62.4 | 52.7 | |
| 2.5% Cu | | 39.0 | 35.5 |
| 3.5% Cu | | 39.3 | 42.0 |

From the results of the table 2 it is noticed that up to a copper content 1.5% the ferrite content is fine, but at the levels greater than this the ferrite content is too low even when annealed at the higher temperature. Typically, increasing the annealing temperature the ferrite content increases by 5-7 volume % as it is the case for the 1.1% Cu and 3.5% Cu alloys. The ferrite content for the 2.5% Cu is the same at both the annealing temperatures. This is probably due to copper being fully dissolved into the ferrite phase at the higher (1150° C.) temperature resulting in the formation of secondary austenite phase counteracting the increase in the ferrite phase.

For the alloys 0.75% Cu, 1.0% Cu and 1.5% Cu the microstructure was determined in the as-forged condition, in which case the ferrite content was between 61-66% for all those alloys. After annealing at the temperature of 1050° C. there was a decrease in the ferrite content by approximately 6-8% for all alloys. From the image analysis it was observed that the decrease in the ferrite content is mostly due to the presence of secondary austenite phase that becomes more apparent as the copper content was increased. In the 1.5% Cu alloy a great deal of the austenite phase exists between the ferrite grains.

The critical pitting temperatures (CPT) were determined for the alloys annealed at the temperature of 1050° C. according to the ASTM G150 test with 1.0 M NaCl. For each alloy the test was done two times (CPT1 and CPT2). The results of these tests are presented in the table 3:

TABLE 3

Critical pitting temperatures (CPT)

| | CPT1 ° C. | CPT2 ° C. | CPT Average ° C. |
|---|---|---|---|
| LDX 2101 ® | 11.4 | 9.7 | 10.6 |
| 1.1% Cu | 15.7 | 13.4 | 14.5 |
| 3.5% Cu | 16.6 | 18.9 | 17.7 |

The results in the table 3 show that in this environment a positive effect of copper on the CPT is given. The CPT is actually highest for the 3.5% alloy despite the presence of copper particles in the microstructure. Surprisingly, this contradicts somewhat the hypothesis that copper particles are detrimental to the pitting resistance.

The testing for cold heading as a part for cold workability was performed on samples in the as-forged and annealed (1050° C.) conditions in order to determine that the duplex ferritic austenitic stainless steel of the invention has better properties when compared with the reference material LDX 2101®. The materials were machined to cylindrical samples with the dimensions of 12 mm×8 mm for compressing the samples at high rates of 200-400 mm/s. Samples were evaluated by noting cracking (failed components) or crack free (passed components).

In this testing method cracking only occurred when the sample was compressed with maximum compression to an actual final thickness of approximately 3 millimeter regardless of the compressing speed. Cracking was slightly more severe under compression at higher speeds.

The cold heading test results are presented in the table 4, where the samples are in the as-forged condition except when annealed at the temperature of 1050° C. the column "Annealed" is provided with the term "Yes":

TABLE 4

Results of mechanical testing

| | Annealed (T = 1050° C.) | Actual final thickness (mm) | Rate (mm/s) | Result |
|---|---|---|---|---|
| LDX 2101 ® | No | 2.7 | 200 | Small crack |
| LDX 2101 ® | Yes | 2.5 | 200 | No cracks |
| LDX 2101 ® | No | 2.5 | 200 | Large crack |
| LDX 2101 ® | Yes | 2.5 | 200 | Small cracks |
| LDX 2101 ® | No | 2.5 | 300 | Crack |
| LDX 2101 ® | Yes | 2.5 | 300 | Cracks |
| LDX 2101 ® | Yes | 2.4 | 300 | Small cracks |
| LDX 2101 ® | No | 2.4 | 400 | Crack |
| LDX 2101 ® | Yes | 2.5 | 400 | No cracks |
| LDX 2101 ® | No | 2.4 | 400 | Crack |
| LDX 2101 ® | Yes | 2.5 | 400 | Large cracks |
| 0.75% Cu | No | 2.4 | 200 | Crack |
| 0.75% Cu | Yes | 2.3 | 200 | Crack |
| 0.75% Cu | No | 2.5 | 200 | Crack |
| 0.75% Cu | Yes | 2.4 | 200 | No cracks |
| 0.75% Cu | No | 2.5 | 300 | Small crack |
| 0.75% Cu | Yes | 2.4 | 300 | Crack |
| 0.75% Cu | No | 2.4 | 300 | Large crack |
| 0.75% Cu | Yes | 2.4 | 300 | Large cracks |
| 0.75% Cu | No | 2.6 | 400 | Crack |
| 0.75% Cu | Yes | 2.3 | 400 | Large cracks |
| 0.75% Cu | No | 2.6 | 400 | Crack |
| 0.75% Cu | Yes | 2.3 | 400 | Large cracks |
| 1.0% Cu | No | 2.7 | 200 | No cracks |
| 1.0% Cu | Yes | 2.7 | 200 | Cracks |
| 1.0% Cu | No | 2.6 | 300 | Small cracks |
| 1.0% Cu | Yes | 2.4 | 200 | Cracks |
| 1.0% Cu | No | 2.7 | 300 | Small cracks |
| 1.0% Cu | Yes | 2.6 | 300 | No cracks |
| 1.0% Cu | Yes | 2.5 | 300 | Small cracks |
| 1.0% Cu | No | 2.5 | 400 | No cracks |

TABLE 4-continued

| Results of mechanical testing | | | | |
|---|---|---|---|---|
| | Annealed (T = 1050° C.) | Actual final thickness (mm) | Rate (mm/s) | Result |
| 1.0% Cu | Yes | 2.6 | 400 | No cracks |
| 1.0% Cu | Yes | 2.4 | 400 | Small cracks |
| 1.5% Cu | No | 2.4 | 200 | No cracks |
| 1.5% Cu | No | 3.1 | 200 | No cracks |
| 1.5% Cu | No | 2.5 | 200 | No cracks |
| 1.5% Cu | yes | 3.1 | 200 | No cracks |
| 1.5% Cu | yes | 2.5 | 200 | No cracks |
| 1.5% Cu | yes | 2.5 | 200 | Small cracks |
| 1.5% Cu | No | 2.5 | 300 | No cracks |
| 1.5% Cu | No | 2.5 | 300 | No cracks |
| 1.5% Cu | yes | 2.4 | 300 | No cracks |
| 1.5% Cu | yes | 2.5 | 300 | Small crack |
| 1.5% Cu | yes | 2.5 | 300 | No cracks |
| 1.5% Cu | No | 2.4 | 400 | No cracks |
| 1.5% Cu | No | 2.4 | 400 | Cracks |
| 1.5% Cu | Yes | 2.5 | 400 | Crack |
| 1.5% Cu | Yes | 2.4 | 400 | Small crack |
| 1.5% Cu | Yes | 2.5 | 400 | No Cracks |

The results in the table 4 show that in tests on the forged material all the samples for LDX 2101° and 0.75% Cu failed because of cracking, whereas the success rate increased as the copper content is increased. All but one of 1.5% Cu samples passed the test in the as-forged condition. After annealing at the temperature of 1050° C., the alloys with up to 1.0% Cu show similar results with approximately one third of the samples passing the test For the 1.5% Cu alloy more than half of the tested components passed the test indicating the positive effect of copper.

Figure 2:
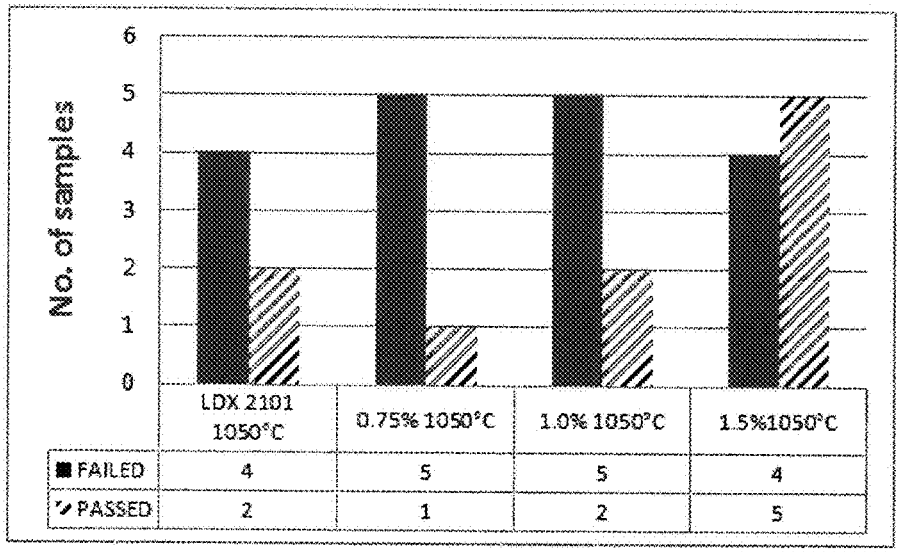
FIG. 2 shows the mechanic test results for steels after annealing at the temperature of 1050° C.

The cold heading test results are also shown in the FIGS. 1 and 2 using the parameters "failed" or "passed" depending on the crack amounts on the steel surface. The FIGS. 1 and 2 show that the portion of "passed" test results increased with the addition of copper both in an as-forged condition and after annealing at the temperature of 1050° C.

The ferritic austenitic stainless steels of the invention were further tested by measuring the impact strength of the steels in order to have information of the impact toughness of the steels. The measurements were made both in an as-forged condition and after annealing at the temperature of 1050° C. In the table 5, the samples are in the as-forged condition except when annealed at the temperature of 1050° C. the column "Annealed" is provided with the term "Yes". Both the table 5 and the FIG. 3 show the results of the measurements for the impact strength.

TABLE 5

| Results of impact testing | | |
|---|---|---|
| | Annealed (T = 1050° C.) | Impact strength J |
| LDX 2101 ® | No | 14.5 |
| LDX 2101 ® | Yes | 20.5 |
| 0.75% Cu | No | 10.5 |
| 0.75% Cu | Yes | 14.5 |
| 1.0% Cu | No | 17.0 |
| 1.0% Cu | Yes | 27.5 |
| 1.5% Cu | No | 28.5 |
| 1.5% Cu | Yes | 36.0 |

Figure 3:
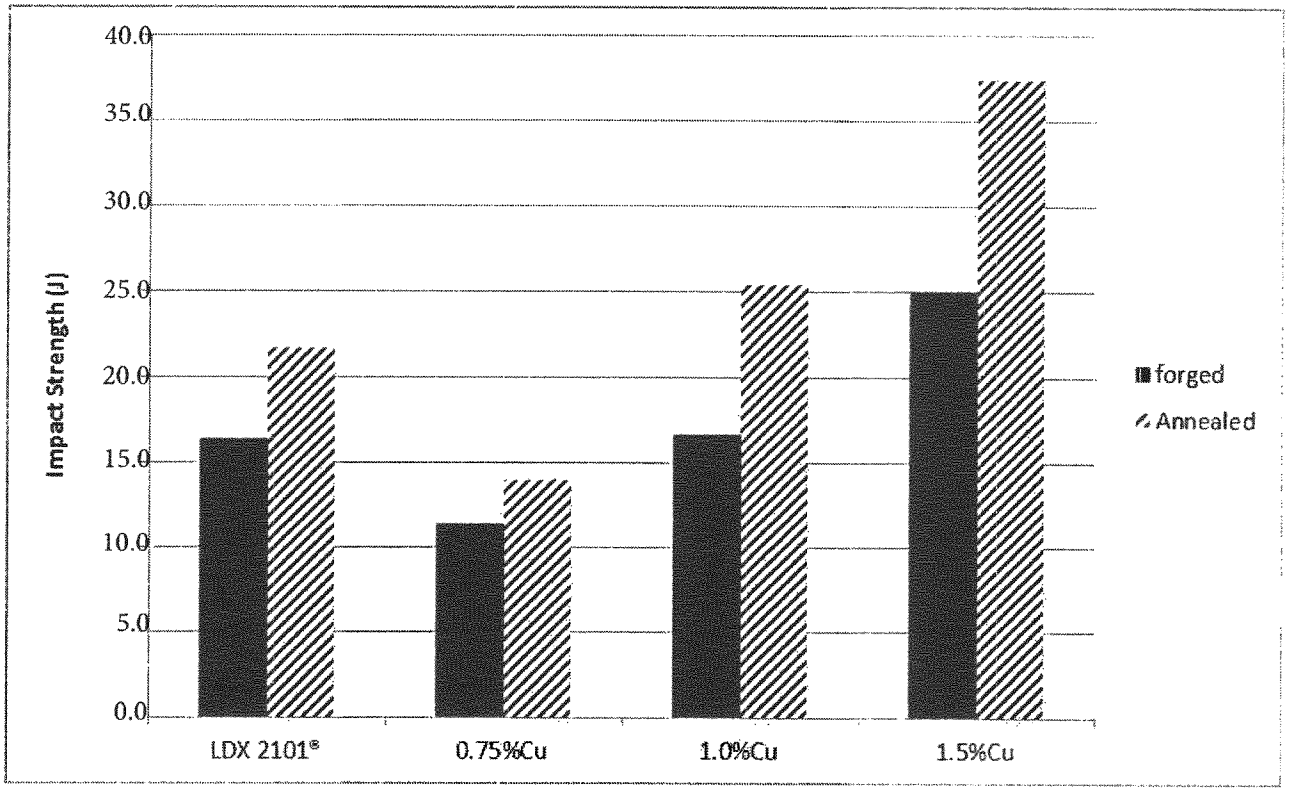
FIG. 3 shows the impact test results for steels both in a as-forged condition and after annealing at the temperature of 1050° C.

The results in the table 5 and in the FIG. 3 show that the addition of copper significantly increases the impact toughness when the copper content is more than 0.75%. As previously mentioned, an increase in copper causes an increase in secondary austenite which can reduce/hinder crack propagation through the ferrite.

The duplex ferritic austenitic steel manufactured in accordance with the invention can be produced as castings, ingots, slabs, blooms, billets and flat products such as plates, sheets, strips, coils, and long products such as bars, rods, wires, profiles and shapes, seamless and welded tubes and/or pipes. Further, additional products such as metallic powder, formed shapes and profiles can be produced.

SEQUENCE LISTING

Not Applicable.

The invention claimed is:

1. A duplex ferritic austenitic stainless steel having 40-60 volume % ferrite and 40-60 volume % austenite, having undergone annealing at a temperature of 1050° C., having an impact strength of at least 27.5 J, wherein the steel consists essentially of in weight % less than 0.07% carbon (C),
0.1-2.0% silicon (Si),
3-5% manganese (Mn),
19-23% chromium (Cr),
1.1-1.9% nickel (Ni),
1.1-1.5% copper (Cu),
0.18-0.30% nitrogen (N),
0.1-1.0% molybdenum (Mo),
greater than 0%-0.5% tungsten (W),
molybdenum (Mo) and tungsten (W) in a total amount abides by the formula $0.1\% < (Mo + \frac{1}{2}W) \leq 1.0\%$,
up to 0.03% of each of cerium (Ce) and/or calcium (Ca), optionally 0.001-0.005% boron (B),
balance being iron (Fe) and inevitable impurities in conditions for the ferrite formers and the austenite formers, wherein for a chromium equivalent ($Cr_{eq}$) and a nickel equivalent ($Ni_{eq}$):

$$20 < Cr_{eq} < 24.5 \text{ and } Ni_{eq} > 10, \text{ wherein}$$

$$Cr_{eq} = Cr + 1.5Si + Mo + 2Ti + 0.5Nb;$$

$$Ni_{eq} = Ni + 0.5Mn + 30(C+N) + 0.5(Cu+Co), \text{ and}$$

wherein the duplex ferritic austenitic stainless steel has an average critical pitting temperature (CPT) of 14.5-17.7° C.

2. The duplex ferritic austenitic stainless steel according to claim 1, having 20-22 weight % chromium.

3. The duplex ferritic austenitic stainless steel according to claim 1, having 21-22 weight % chromium.

4. The duplex ferritic austenitic stainless steel according to claim 1, having 21.2-21.8 weight % chromium.

5. The duplex ferritic austenitic stainless steel according to claim 1, having 1.35-1.9 weight % nickel.

6. The duplex ferritic austenitic stainless steel according to claim 1, having 3.8-5.0 weight % manganese.

7. The duplex ferritic austenitic stainless steel according to claim 1, having 3.8-4.5 weight % manganese.

8. The duplex ferritic austenitic stainless steel according to claim 1, having 0.20-0.26 weight % nitrogen.

9. The duplex ferritic austenitic stainless steel according to claim 1, having 0.20-024 weight % nitrogen.

10. The duplex ferritic austenitic stainless steel according to claim 1, having 0.1-0.8 weight % molybdenum (Mo).

11. The duplex ferritic austenitic stainless steel according to claim 1, having 0.1-0.65 weight % molybdenum (Mo).

12. The duplex ferritic austenitic stainless steel according to claim 1, having 0.15-1.0 weight % molybdenum (Mo).

13. The duplex ferritic austenitic stainless steel according to claim 1, having 0.15-0.8 weight % molybdenum (Mo).

14. The duplex ferritic austenitic stainless steel according to claim 1, having 0.15-0.65 weight % molybdenum (Mo).

15. The duplex ferritic austenitic stainless steel according to claim 1, having 0.15-0.54 weight % molybdenum (Mo).

* * * * *